United States Patent [19]

Perkins

[11] 3,994,335

[45] Nov. 30, 1976

[54] MULTIZONE AIR CONDITIONING SYSTEM

[75] Inventor: Charles H. Perkins, Newtown Square, Pa.

[73] Assignee: Robertshaw Controls Company, Richmond, Va.

[22] Filed: Mar. 6, 1975

[21] Appl. No.: 555,928

[52] U.S. Cl. ..... 165/35; 165/103; 165/27; 137/601; 137/607; 251/77; 236/13

[51] Int. Cl.[2] ..... F24F 3/00; F24F 13/04

[58] Field of Search ..... 236/13, 49; 165/16, 165/103, 35, 36, 27; 98/38 B, 110; 137/601, 607, 287, 288, 527, 595; 251/305, 77

[56] References Cited

UNITED STATES PATENTS

| | | | |
|---|---|---|---|
| 3,023,771 | 3/1962 | Hinds | 137/527 X |
| 3,323,584 | 6/1967 | Serratto | 165/103 |
| 3,604,453 | 9/1971 | Boitnott | 137/527 |
| 3,635,245 | 1/1972 | Canfield | 165/103 |
| 3,847,210 | 11/1974 | Wells | 165/103 |
| 3,911,953 | 10/1975 | Crombie et al. | 165/103 X |

*Primary Examiner*—Albert W. Davis, Jr.
*Attorney, Agent, or Firm*—O'Brien & Marks

[57] ABSTRACT

In a multizone air control system employing constant flows of hot and cold air, the hot or cold air is variably mixed with recirculated air to provide zone temperature control.

3 Claims, 12 Drawing Figures

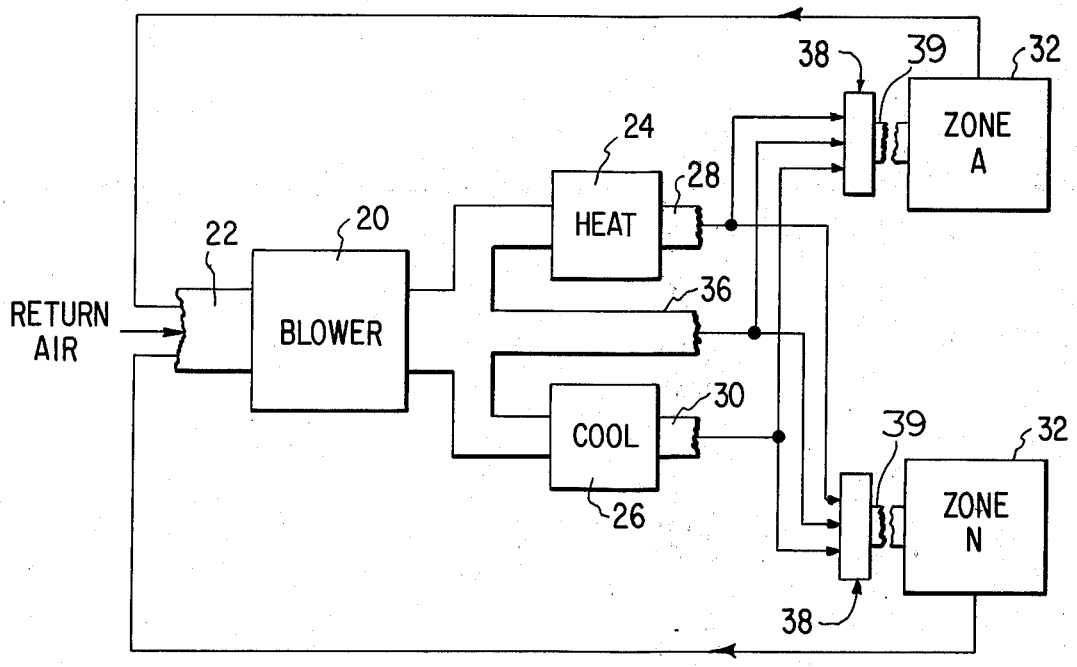
FIG. 1
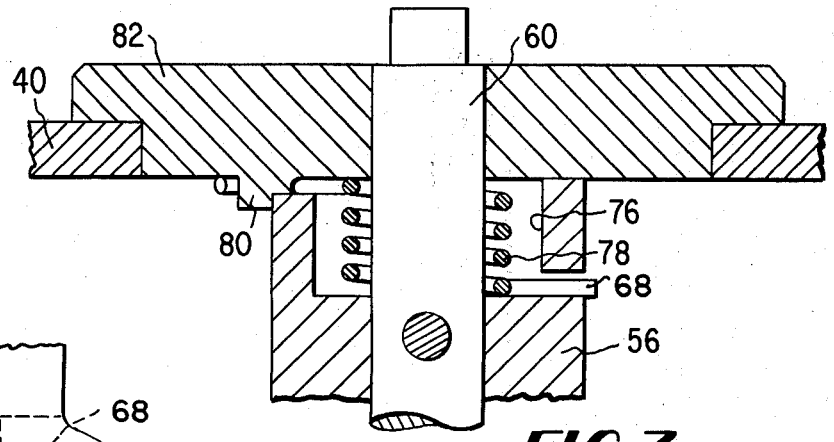
FIG. 7
FIG. 6
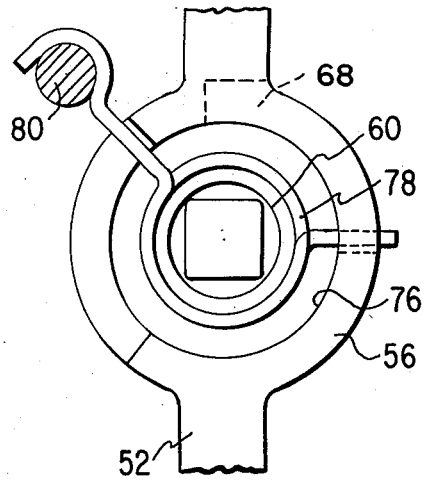

FIG. 2
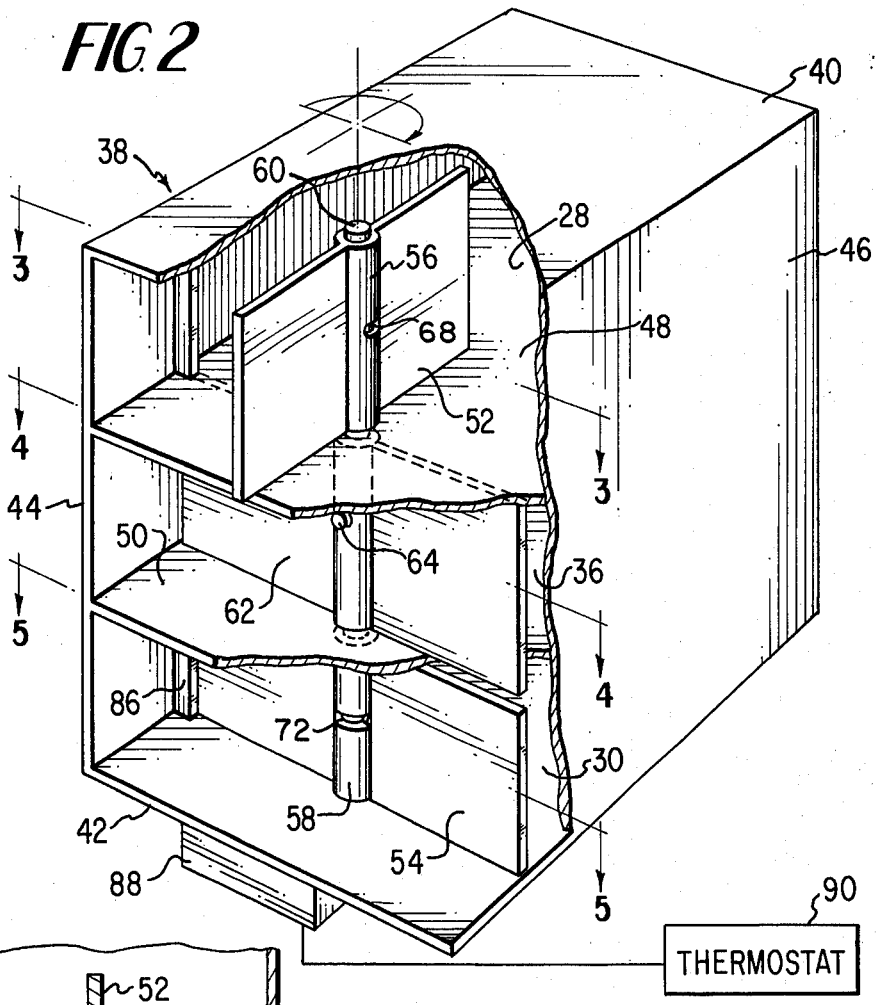
FIG. 3
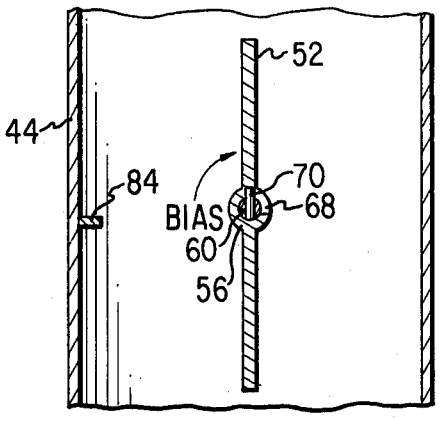
FIG. 5
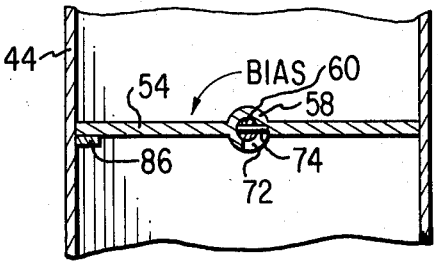
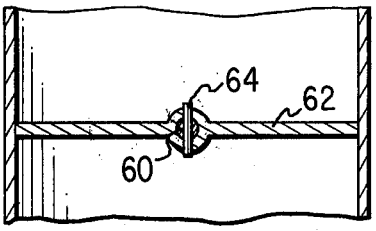
FIG. 4

FIG. 8
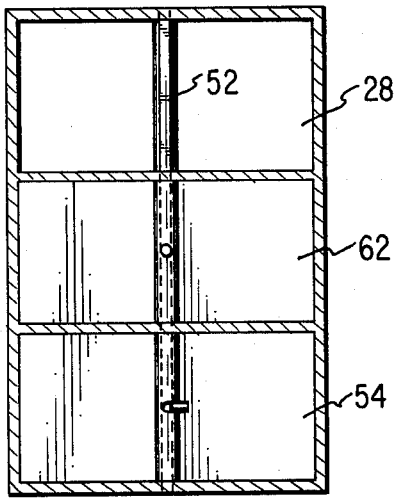
FIG. 9
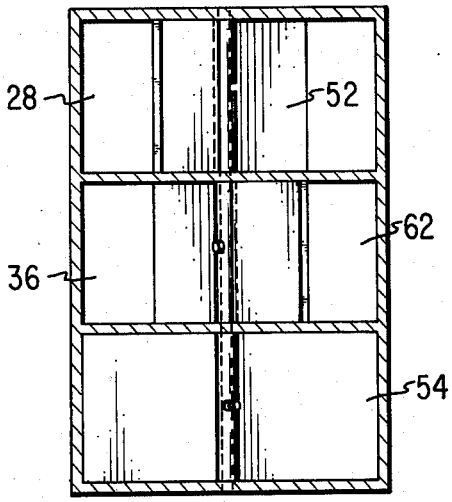
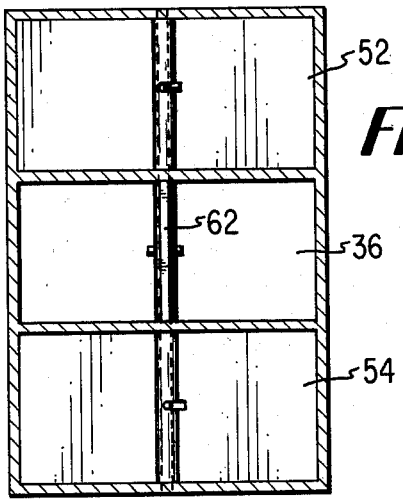
FIG. 10
FIG. 11
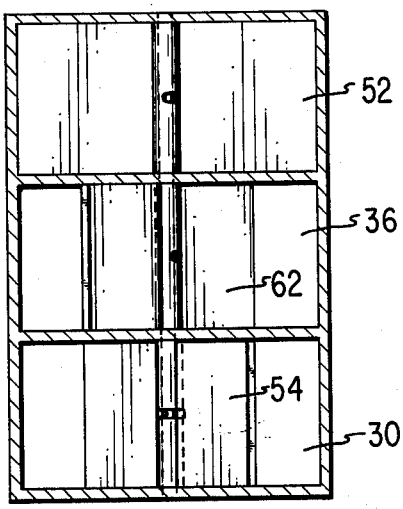
FIG. 12
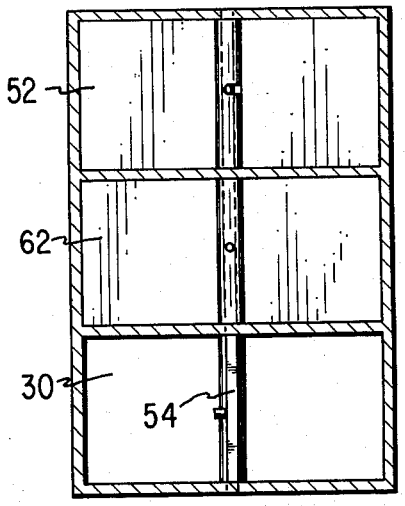

MULTIZONE AIR CONDITIONING SYSTEM

BACKGROUND OF THE INVENTION

1. Field of the Invention

This invention relates to multizone air temperature control systems having a continuous flow of air, and particularly to such systems having a continuous supply of both hot and cold air.

2. Description of the Prior Art

The prior art, as exemplified in U.S. Pats. No. 1,859,427, No. 1,942,295, No. 2,333,729, No. 2,699,106, No. 3,143,864, No. 3,625,022 and No. 3,782,448, contains a number of heating and air conditioning units or systems. In prior art multizone temperature control systems, continuous flows of heated and cooled air are mixed in the proportion necessary to supply the required heating or cooling of each zone; the utilization of the mixture of the heated and cooled air to supply the air flow requires excessive quantities of heated and cooled air and thus needlessly expends energy to heat and cool the extra quantities of hot and cold air.

SUMMARY OF THE INVENTION

The invention is summarized in that an air temperature control system for a plurality of zones includes return duct means for conducting air from the plurality of zones; first supply duct means for conducting heated air; second supply duct means for conducting cooled air; third supply duct means for conducting recirculated return air; blower means for moving air through the return duct means from the plurality of zones and for moving first, second and third portions of air from the return duct means through the respective first, second and third supply duct means; means for heating the first portion of air; means for cooling the second portion of air; and air flow control means for selectively passing air from the third supply duct means together with air from either the first supply duct means or the second supply duct means to each respective zone.

An object of the invention is to reduce the amount of the heated air and cooled air necessary for heating and cooling a plurality of zones to thus conserve energy.

Another object of the invention is to variably mix return air with either heated or cooled air to provide the necessary heating and cooling.

It is also an object of the invention to construct a three damper control device for controlling air flow from a hot air duct, a cold air duct, and a recirculated air duct.

Other objects, advantages and features of the invention will become apparent from the following description taken in conjunction with the accompanying drawings.

BRIEF DESCRIPTION OF THE DRAWINGS

FIG. 1 is a block diagram of an air control system in accordance with the invention.

FIG. 2 is a perspective view of a damper device of the system of FIG. 1.

FIG. 3 is a top cross sectional view of one damper in the device of FIG. 2.

FIG. 4 is a top cross sectional view of a second damper in the device of FIG. 2.

FIG. 5 is a top cross sectional view of a third damper in the device of FIG. 2.

FIG. 6 is a detailed top view of biasing means for the device of FIG. 2.

FIG. 7 is an elevation view in cross section of the biasing means of FIG. 6.

FIG. 8 is a front elevation view of the device of FIG. 2 in a first position.

FIG. 9 is a front elevation view of the device of FIG. 2 in a second position.

FIG. 10 is a front elevation view of the device of FIG. 2 in a third position.

FIG. 11 is a front elevation view of the device of FIG. 2 in a fourth position.

FIG. 12 is a front elevation view of the device of FIG. 2 in a fifth position.

DESCRIPTION OF THE PREFERRED EMBODIMENT

As illustrated in FIG. 1, the invention is embodied in a temperature control system including a blower means 20 having an input from a return air duct 22, a heat deck 24 connected to the output of the blower means 20 for heating air passed to a hot air duct 28, and a cooling deck 26 connected to the output of the blower means 20 for cooling air passed to a cold air duct 30. The blower means 20, the heat deck 24, and the cooling deck 26 are substantially similar to conventional facilities normally employed in multizone air control systems supplying simultaneous flows of heated air and cooled air.

A recirculating air duct 36 is suitably connected to the output of the blower means 20 to receive a flow of recirculating return air. The ducts 28, 30 and 36 are conconnected to a plurality of parallel damper devices indicated generally at 38 for selectively passing air from the ducts 28, 30 and 36 to a plurality of zone ducts 39 connecting the outputs of the respective devices 38 to the respective zones 32 such as rooms in a building.

As shown in FIG. 2, each of the devices 38 has a top horizontal wall 40, a bottom horizontal wall 42 and vertical side walls 44 and 46. A divider wall 48 extends between the walls 44 and 46 forming a common wall between the hot air duct 28 and recirculating return air duct 36, and a divider wall 50 extends between the vertical walls 44 and 46 forming a common wall between the cold air duct 30 and the recirculated return air duct 36. Dampers 52 and 54 have respective hubs 56 and 58 rotatively mounted on a vertical shaft 60 which is suitably journaled in the walls 40, 42, 48 and 50. The damper 52 is positioned in the hot air duct 28 while the damper 54 is positioned in the cold air duct 30. A damper 62 positioned within the recirculating air duct 36 is fixed by a suitable fastening device 64, as shown in FIG. 4, for rotation with the shaft 60. The dampers 52, 54 and 62 are suitable vanes or the like for substantially closing and variably opening the respective ducts 28, 30 and 36 to passage of air therein.

As shown in FIG. 3, the hub portion 56 has a slot 68 formed through a 90 degree arc thereof. A pin 70 fixed in the shaft 60 has one end extending in the slot 68 such as to limit clockwise rotative movement of the damper 52 relative to the shaft 60. As shown in FIG. 5, the hub portion 58 of the damper 54 also has a slot 72 through a 90° arc of the hub 58; and the shaft 60 has a pin 74 fixed therein and extending into the slot 72 to limit counter clockwise movement of the damper 54 about the shaft 60. The hub 56, as shown in FIGS. 6 and 7, has a circular cylindrical cavity 76 coaxial with the shaft 60 and larger than the shaft 60. A torsion coil spring 78 is positioned within the cavity 76 coaxial with the shaft 60 and has one end suitably fixed to the hub 56 while its other end engages an abutment 80 on an access plate or a journal plate 82 fixed in the wall 40. The torsion spring 78 is such that it provides a clockwise bias, as viewed in FIG. 3, for the damper 52 about the shaft 60. A similar torsion spring (not shown) is provided within a similar cavity (not shown) in the hub portion 58 for biasing the damper 54 in a counterclockwise direction, as viewed in FIG. 5, about the shaft 60.

A suitable mechanism 88 operated by a zone thermostat 90 is provided for rotating the shaft 60 through a 180° angle of rotation. The mechanism 88 and thermostat 90 are substantially similar to conventional damper rotating mechanisms and thermostats for controlling damper systems in temperature control systems mixing heated air with cooled air.

The damper 62 is positioned on the shaft 60 such that the damper 62 is (1) in a first fully closed position when the shaft 60 is in a most counterclockwise position as shown in FIGS. 2, 4, and 8; (2) in a fully open position when the shaft 60 is in an intermediate point of rotation as shown in FIG. 10; and (3) in a second fully closed position when the shaft 60 is in a most clockwise rotative position as shown in FIG. 12. The pin 70 in the slot 68 together with the torsion spring 78 are such that the damper 52 is biased into a fully open position when the shaft 60 is in its most counterclockwise rotative position as viewed in FIG. 3. A stop 84 is mounted on the wall 44 for engaging the damper 52 to hold the damper 52 in the fully closed position as the shaft 60 is rotated from its intermediate point to its most clockwise position as illustrated in FIGS. 10, 11 and 12. The pin 74 in the slot 72 in the damper 54 and the associated torsion spring are such that the damper 54 is biased into its fully open position, as illustrated in FIG. 12, when the shaft 60 is in its most clockwise rotative position. A stop 86 is mounted on the wall 44 for engaging the damper 54 to hold the damper 54 in its fully closed position as the shaft 60 is rotated between its intermediate position and its most counter clockwise position as shown in FIGS. 8, 9 and 10.

In operation of the air temperature control system of FIG. 1, a first portion of air drawn through return duct 22 from the zones 32 is passed through the heating deck 24 where the first portion of air is heated and passed to the hot air duct 28. A second portion of air from the blower means 20 is passed through the cooling deck 26 where it is cooled and passed into the cold air duct 30. A third portion of the air is passed by the blower means 20 from the return air duct 22 directly to the recirculating air duct 36 without any heating or cooling. The damper devices 38 supply either hot air from the hot duct, cold air from the cold duct 30, or recirculated air from the duct 35 to the respective zones 32, or the damper devices 38 supply a mixture of hot air and recirculated air from the ducts 28 and 30 or a mixture of cold air and recirculated air from the ducts 30 and 36 in accordance with the demand of the respective zones.

As shown in FIGS. 2, 3, 4, 5 and 8, the shaft rotation mechanism 88 in response to the thermostat 90 demanding a maximum heat at a selected zone rotates the shaft 60 to the most counterclockwise position wherein the damper 52 is fully open and the dampers 54 and 62 are fully closed. The damper 54 is biased against the stop 86 under the force of the torsional spring associated therewith.

Should the thermostat 90 require a flow of heated air which is less than the maximum heating, the mechanism 88 rotates the shaft 60 to a point between its intermediate position and its most counterclockwise position, for example 45° as shown in FIG. 9, to partially open the damper 62 and to partially close the damper 52 to thus provide a predetermined ratio of hot air flow from the duct 28 to the recirculated air flow from the duct 36.

When the thermostat 90 requires no heating or cooling, the shaft 60 is rotated to its intermediate point wherein the dampers 52 and 54 are both closed and the damper 62 is fully open providing for only recirculated return air flow from the duct 36 as shown in FIG. 10.

When partial cooling less than maximum cooling air flow is required, the shaft 60 is rotated to a position between its intermediate point and its most clockwise rotative position, for example 45°, as shown in FIG. 11. The dampers 54 and 62 are both partially open in accordance with the demand for the selected amount of cooling air flow to provide a mixture of cool air from the duct 30 and recirculated return air from the duct 36 in accordance with the demand.

In the event maximum cooling is required the shaft 60 is rotated to its most clockwise position as shown in FIG. 12 to fully open the damper 54 and render both of the dampers 62 and 52 fully closed thus providing for only cold air flow.

As seen in FIGS. 6 and 7 the torsion spring 78 biases the damper 52 clockwise relative to the shaft 60 such that the pin 70 engages the most counter clockwise edge of the slot 68 as shown in FIG. 3. When the damper 52 engages the stop 84, the shaft 60 is free to rotate relative to the hub 56 against the force of the spring 78 to maintain the damper 52 closed while engaging the stop 84. Similarly the damper 54 is biased counter-clockwise relative to shaft 60 and pin 74 to provide for engagement of the damper 54 with the stop 86 during movement of the shaft 60 between its intermediate point and its most counter clockwise position.

Since many modifications, changes in detail, and variations may be made in the described embodiment, it is intended that all matter in the foregoing description and shown in the accompanying drawings be interpreted as illustrative and not in a limiting sense.

What is claimed is:

1. A damper system for controlling flow of air through a hot air duct, a cold air duct and a recirculating air duct, the system comprising first, second, and third dampers in the respective hot air, cold air, and recirculating air ducts, a shaft extending through the hot, cold and recirculating air ducts and rotatable through a predetermined angle, said third damper being fixedly mounted on the shaft for movement from a first closed position to an open position and to a second closed position as the shaft is rotated in a first direction through the predetermined angle, said first damper having a first hub rotatively mounted on the shaft, said first hub having a first slot extending through one-half of the predetermined angle about the hub, a pin extending from the shaft into the first slot for engaging one end of the first slot to move the first damper from the closed position to the open position during rotation of the shaft in the second direction while the third damper moves from the open position to the first closed position, said second damper having a second hub rotatively mounted on the shaft, said second hub having a second slot extending through one-half of the predetermined angle about the hub, a pin extending from the shaft into the second slot for engaging one end of the second slot to move the second damper from the closed position to the open position during rotation of the shaft in the first direction while the third damper rotates from the open position to the second closed position, first and second stop means mounted in the respective hot air and cold air ducts for stopping rotation of the first and second dampers in the closed position, spring means biasing the respective first and second dampers against the respective first and second stop means and biasing the hubs toward engagement of the one end of the first and second slots with the first and second pins, and temperature responsive means for variably controlling the rotative position of the shaft.

2. A system as claimed in claim 1 wherein the predetermined angle is 180°.

3. A system as claimed in claim 1 wherein the first and second hubs have first and second cylindrical cavities coaxial and larger than the shaft, the spring means includes first and second coil torsion springs coaxial with the shaft within the respective cavities and biasing the first and second dampers in opposite rotative directions about the shaft.

* * * * *